US005509475A

United States Patent [19]

Lewis

[11] Patent Number: 5,509,475

[45] Date of Patent: Apr. 23, 1996

[54] DOWNHOLE STRESS ABSORBER

[76] Inventor: Gary W. Lewis, R.R. 1, Box 398-B1, Bartlesville, Okla. 74003

[21] Appl. No.: 421,233

[22] Filed: Apr. 13, 1995

[51] Int. Cl.[6] ..... E21B 43/00

[52] U.S. Cl. ..... 166/68; 166/105; 417/554

[58] Field of Search ..... 166/105, 109, 166/68, 68.5; 417/399, 398, 554

[56] References Cited

U.S. PATENT DOCUMENTS

| | | | |
|---|---|---|---|
| 172,903 | 2/1876 | Adams . | |
| 191,159 | 5/1877 | Krum . | |
| 690,676 | 1/1902 | Tait . | |
| 1,788,363 | 1/1931 | Brooks et al. . | |
| 1,958,915 | 5/1934 | Fletcher | 116/109 |
| 2,005,564 | 6/1935 | Schalscha | 61/77 |
| 2,212,153 | 8/1940 | Eaton et al. | 255/28 |
| 2,252,912 | 8/1941 | Armentrout | 166/109 |
| 2,286,926 | 6/1942 | Parenti | 166/68.5 |
| 2,331,631 | 10/1943 | Rogers et al. | 166/109 |
| 2,524,707 | 10/1950 | Koeln | 255/27.1 |
| 3,363,475 | 1/1968 | Foster et al. | 74/103 |
| 3,501,997 | 3/1970 | Winsen et al. | 89/44 |
| 3,947,009 | 3/1976 | Nelmark | 267/137 |
| 3,963,228 | 6/1976 | Karle | 267/166 |
| 4,139,994 | 2/1979 | Alther | 64/23 |
| 4,176,714 | 12/1979 | Case | 166/72 |
| 4,210,316 | 7/1980 | Hall | 167/125 |
| 4,354,395 | 10/1982 | Page, Jr. | 74/41 |
| 4,354,397 | 10/1982 | Fix | 74/108 |
| 4,398,898 | 8/1983 | Odom | 464/20 |
| 4,552,230 | 11/1985 | Anderson | 175/321 |
| 4,571,162 | 2/1986 | Knox | 417/554 |
| 4,619,334 | 10/1986 | Gustafsson | 175/321 |
| 4,661,052 | 4/1987 | Ruhle | 166/105 X |
| 4,969,518 | 11/1990 | Schmitt et al. | 166/228 |
| 4,997,037 | 3/1991 | Coston | 166/105 |
| 5,351,752 | 10/1994 | Wood et al. | 166/68 |
| 5,450,897 | 9/1995 | Brown | 166/68 |

*Primary Examiner*—Frank S. Tsay
*Attorney, Agent, or Firm*—Frank J. Catalano; Scott R. Zingerman

[57] ABSTRACT

In a downhole sucker rod string stress absorber, a relatively inelastic plunger of circular cross-section is mounted on a concentric shaft extending upwardly to an upper portion of the sucker rod string. A resiliently compressible cushion of circular cross-section is disposed below the plunger and above a lower portion of the sucker rod string. A disk may be seated between the cushion and the plunger to distribute forces more evenly on the surface of the cushion. A resiliently compressible cylindrical sleeve, preferably having a plurality of annular grooves spaced thereabout, surrounds the shaft above the plunger. A coupling, adapted for connection to the lower portion of the sucker rod string, has a threaded end with a compressive face which abuts the outer end of the compressible cushion. A guide slidably mounted on the shaft has a threaded end with a compressive face thereon which abuts the outer end of the compressible sleeve. A cylindrical housing connects the coupling and the guide with the compressible cushion, the compressible sleeve and the plunger therebetween, the length of the housing being such that the compressible cushion and sleeve are increasingly partially compressed between the compressive faces as the guide and/or coupling are threaded further into the housing.

23 Claims, 3 Drawing Sheets

DOWNHOLE STRESS ABSORBER

BACKGROUND OF THE INVENTION

This invention relates generally to equipment for maximizing efficiency of oil well pump systems and more particularly concerns stress absorbers for reducing or eliminating the damaging effects resulting from the forces exerted on the system in the upward and downward strokes of the sucker rod string.

The forces exerted in the upward and downward strokes of the sucker rod string, whether resulting from the weight of the string itself and/or vacuum conditions created by the pumping, are a major cause of damage to pumps as well as to the string itself and therefore of costly down time in oil well pumping operations.

The significance of the problem is evidenced by the myriad attempts to resolve it, most of which involve shock absorbing systems which are mounted at ground level. While such above ground systems do provide some relief, this remote location from the actual points of stress minimizes their effectiveness. Those devices which have been proposed for downhole rather than surface use have been generally ineffective in operation or cost prohibitive.

It is, therefore, an object of this invention to provide a stress absorber that will reduce the stress exerted in the sucker rod string at the point of stress. It is also an object of this invention to provide a stress absorber that is uncomplicated in its design, easy to install and remove and easy to maintain and repair. It is a further object of this invention to provide such a stress absorber that is relatively inexpensive.

SUMMARY OF THE INVENTION

In accordance with the invention, a downhole sucker rod string stress absorber is provided having a relatively inelastic plunger of circular cross-section concentrically mounted on a shaft extending upwardly for connection to an upper portion of the sucker rod string. A resiliently compressible cushion of circular cross-section is disposed below the plunger and above a lower portion of the sucker rod string. A resiliently compressible cylindrical sleeve, preferably having a plurality of annular grooves spaced thereabout, surrounds the shaft above the plunger. A coupling, adapted for connection to the lower portion of the sucker rod string, has a threaded end with a compressive face which abuts the outer end of the compressible cushion. A guide slidably mounted on the shaft has a threaded end with a compressive face which abuts the outer end of the compressible sleeve. A cylindrical housing connects the coupling and the guide with the compressible cushion, the compressible sleeve and the plunger between the compressive faces, the length of the housing being such that the compressible cushion and sleeve are increasingly partially compressed between the compressive faces as the guide and/or coupling are threaded further into the housing.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION

Figure 1:
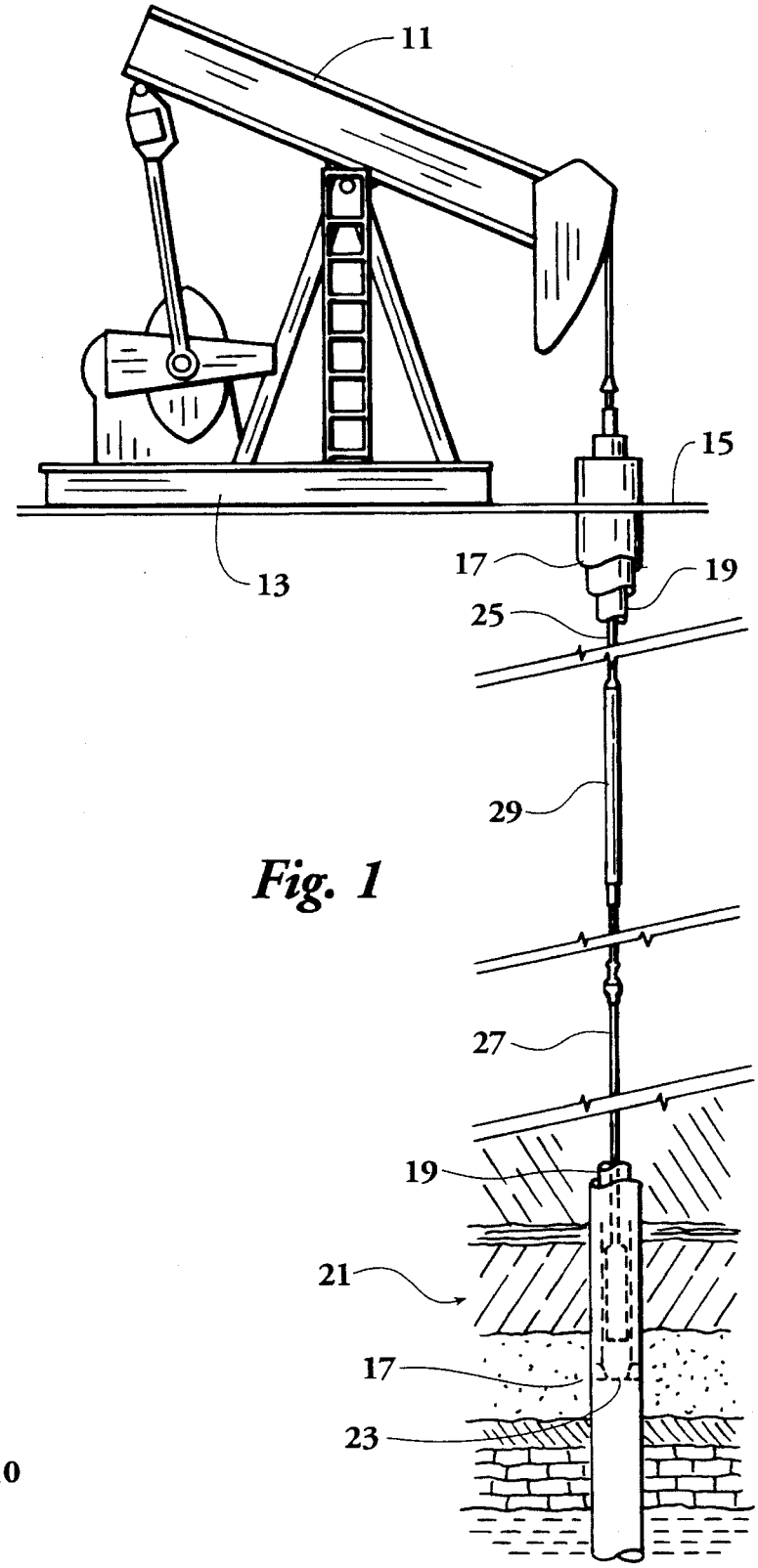
FIG. 1 is a side elevational view with parts broken away illustrating the well pumping environment of the stress absorber.

Turning first to FIG. 1, the environment in which the present stress absorber is to be employed is illustrated. A well pumping unit 11 is mounted on a foundation 13 on the earth's surface 15. A well casing 17 and production line tubing 19 extend from the surface 15 to an oil production zone 21 where a pump 23 is located. Connecting the pumping unit 11 to the pump 23 is a sucker rod string which extends through the tubing 19. As shown, the sucker rod string consists of an upper portion 25 and a lower portion 27 in relation to the stress absorber 29 which is inserted in the sucker line string. Any number of stress absorbers 29 may be used in the same string and will be applied at those points in any given string which are known to experience the greatest stress. For example, stress absorbers might frequently be located approximately fifteen to twenty sucker rods above the pump level and ten to twenty sucker rods below the surface level.

Figure 2:
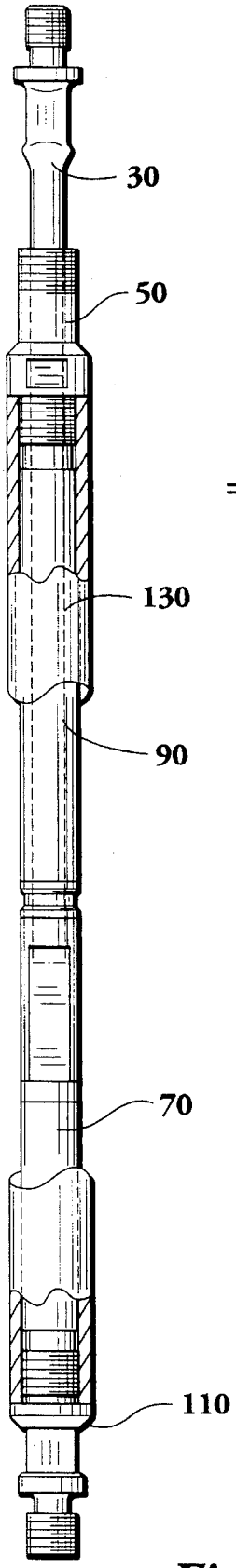
FIG. 2 is an elevational view with parts broken away illustrating a preferred embodiment of the stress absorber.

Turning to FIG. 2, the component elements of the stress absorber 29 can be identified. They include a plunger assembly 30 which connects at its upper end to an upper portion 25 of the sucker rod string, a plunger guide 50 which slides on the shaft of the plunger assembly 30, a primary stress absorber 90 disposed beneath the plunger guide 50, a secondary stress absorber 70 located below the plunger head of the plunger assembly 30, a coupling 110 connected to a lower portion 27 of the sucker rod string below the stress absorber 29 and a housing 130 connected between the plunger guide 50 and the coupling 110 and encasing all of the other elements of the stress absorber 29.

The basic operation of the device can be understood by continued reference to FIG. 2. During the downstroke of the pumping unit 11, the impact of the downstroke is absorbed by the secondary stress absorber 70 as the plunger head of the plunger assembly 30 is driven against the upper face of the secondary stress absorber 70. On the upstroke, the pressure exerted on the secondary stress absorber 70 is gradually released and, as the upper portion of the plunger head of the plunger assembly 30 impacts against the lower surface of the primary stress absorber 90, the primary stress absorber 90 absorbs the stress of the upstroke.

A more detailed illustration of the component parts of the stress absorber 29 is illustrated in FIGS. 3 through 8.

Figure 3:
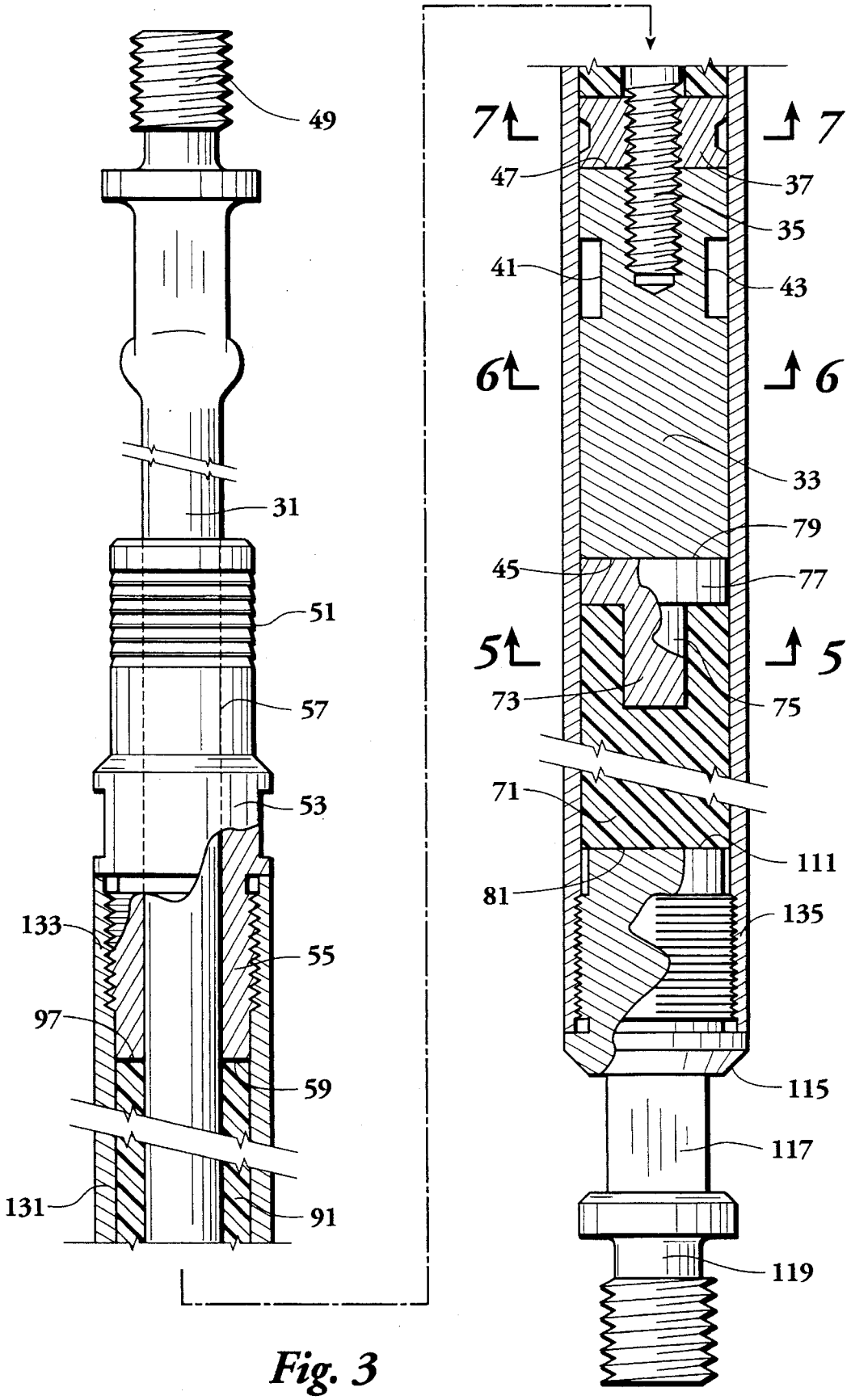
FIG. 3 is an exploded elevational view with parts broken away of the preferred embodiment of the stress absorber of FIG. 2.
Figure 7:
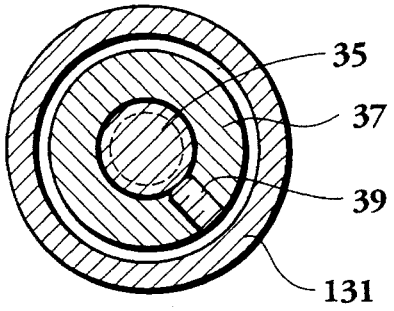
FIG. 7 is a cross-sectional view taken along the line 7—7 of FIG. 3.
Figure 6:
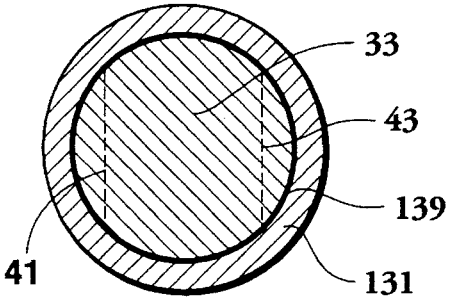
FIG. 6 is a cross-sectional view taken along the line 6—6 of FIG. 3.

Looking first at FIG. 3, it can be seen that the plunger assembly 30 consists of an elongated shaft 31 which extends downwardly to a plunger head 33 which is engaged to a threaded portion 35 of the shaft 31. Preferably, a lock nut 37, also shown in FIG. 7, is mounted on the threaded end 35 of the shaft 31 above the plunger head 33 so that, when the plunger head 33 is threaded to the appropriate length on the shaft 31, the lock nut 37 can be tightened down to secure the plunger head 33 in position. Preferably, the lock nut 37 will be provided with a set screw 39 which may be tightened down on the threaded portion 35 of the shaft 31 to secure the lock nut 37 against rotation on the threaded portion 35 of the shaft 31. The plunger head 33 is also provided with a pair of diametrically opposed tool flats 41 and 43 for triggering the plunger head 33 in position against the lock nut 37.

The upper portion of the plunger shaft 31 extends through the plunger guide 50 which consists of an upper guide portion 51, an intermediate tooling flat segment 53 and a lower externally threaded portion 55. A cylindrical bore 57 through the guide 50 is such that the plunger shaft 31 may freely slide within the guide 50. A lower end face 59 of the guide 50 is transverse to the axis of the shaft 31 and provides an upper compression surface for the stress absorber 29.

Figure 5:
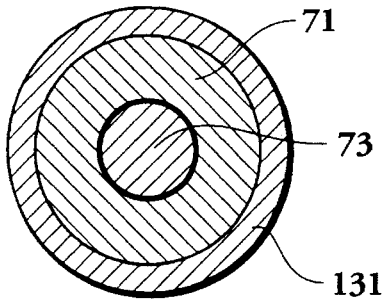
FIG. 5 is a cross-sectional view taken along the lines 5—5 of FIG. 3.

The secondary stress absorber 70, shown also in FIG. 5, consists of a cylindrical cushion 71 of rubber-like or other resiliently compressible material. The cushion 71 may, as shown, have a concentric seat 73 in its upper portion to receive a concentric seating pin 75 of a disk 77 which rests on the upper surface of the cushion 71. Thus, a lower face 45 of the plunger head 33, preferably made of steel, will contact an upper face 79 of the disk 77, which also is preferably made of steel. Thus, the impact of the plunger head 33 on the downstroke can be more evenly distributed through the disk 77, over the surface of the compressible cushion 71 thus extending the life of the cushion 71.

However, the use of a single cylindrical cushion 71 without the seat 73, pin 75 and disk 77 is preferred.

Figure 8:
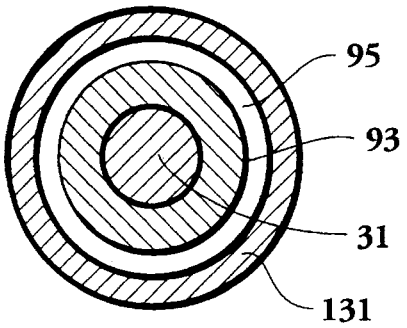
FIG. 8 is a cross-sectional view taken along the line 8—8 of FIG. 4.
Figure 4:
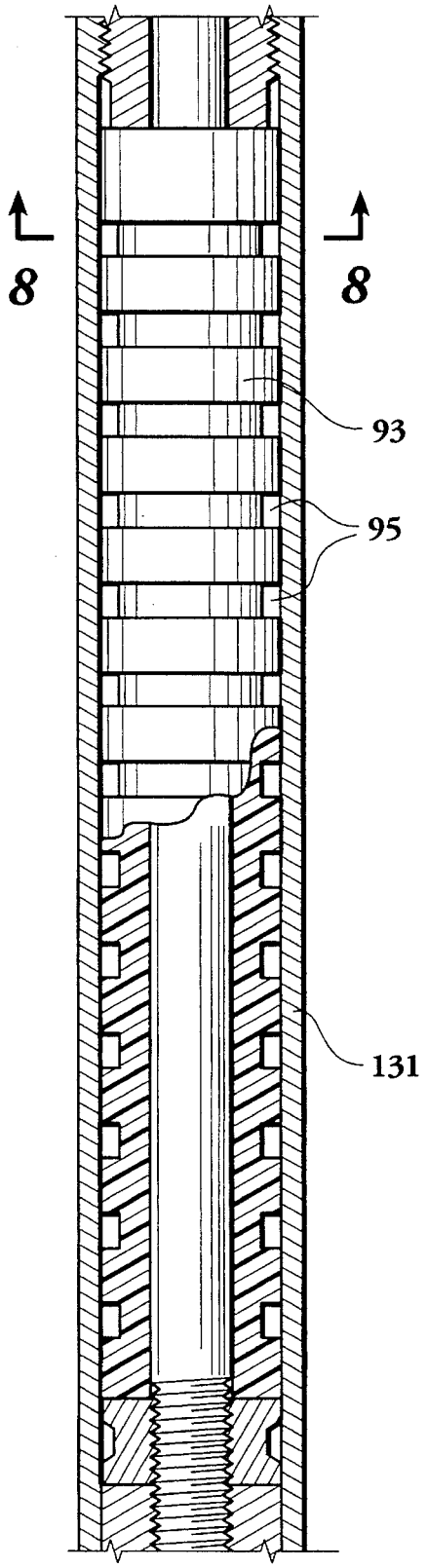
FIG. 4 is a partial elevational view with parts broken away illustrating another embodiment of the primary stress absorbing cylinder of the stress absorber.

The primary stress absorber 90 preferably consists of a cylindrical sleeve 91, also of rubber-like or other resiliently compressive material, which surrounds the shaft 31 and extends along the shaft 31 from the lower end face 59 of the plunger guide 50 to the upper face of the lock nut 37 in the plunger assembly 30. If the lock nut 37 is not employed, the sleeve 91 extends to the upper surface 47 of the plunger head 33. An alternate embodiment of the primary stress absorber is illustrated in FIGS. 4 and 8. In this embodiment, a cylindrical sleeve or member 93 has a plurality of annular grooves 95 spaced along its length to facilitate compression along the full length of the member 93. As shown, the grooves 95 are spaced at equal intervals from each other, but any spacing arrangement could be employed so as to provide the most desirable compression characteristics of the primary stress absorber 90 for a given well operation.

As a further alternative, the cylindrical member 93 can be formed by a plurality of stacked compressible donuts spaced by washers or any known stackable compressive device similar to Belleville washers and the like.

A lower face 81 of the secondary stress absorber 70 rests on an upper face 111 of the coupling 110. This upper face 111 is transverse to the axis of the shaft 31 and provides a lower compressive surface for the stress absorber 29. The coupling 110 consists of an upper threaded portion 113 and a cap 115 extending downwardly from the upper force 111, an intermediate tool flat segment 117 and a lower rod adapter portion 119 at which the coupling 110 may be connected the lower portion 27 of the sucker rod string.

The lower threaded portion 55 of the plunger guide 50 is connected to the upper threaded portion 113 of the coupling 110 by the housing 130 which consists of a cylindrical sleeve 131 having complementarily threaded upper and lower ends 133 and 135. As shown, the housing 130 encases all of the other elements of the device. When repair or replacement of sucker rod string components is desired, rotation of the string will also cause rotation of the stress absorber 29 so that components will not be disconnected and lost in the process.

To assemble the stress absorber 29, the plunger guide 50 is first slipped onto the shaft 31 of the plunger assembly 30. The primary stress absorber 90 is then slipped onto the shaft 31 so that its upper end 97 can be brought into abutment with the lower face 59 of the plunger guide 50. The lock nut 37 is then threaded onto the lower portion 35 of the shaft 31 and the plunger head 33 threaded to its desired depth on the threaded end 35 of the shaft 31. With the plunger head 33 in its appropriate position, the lock nut 37 is tightened down onto the plunger head 33 and the set screw 39 tightened to secure the lock nut 37 in place. This assembly is then inserted into the threaded upper end 133 of the housing 130. If desired, the seating pin 75 on the disk 77 is then seated in the concentric seat 73 of the cushion 71 to form the secondary stress absorber 70. The secondary stress absorber 70 is then inserted into the threaded lower end 135 of the housing 130 with the disk 77, if used, entering the housing 130 first. The upper threaded portion 113 of the coupling 110 is then inserted into the lower threaded end 135 of the housing 130. The coupling 110 and/or the plunger guide 50 are then screwed into the housing 130. As this process takes place the secondary and primary stress absorbers 70 and 90, with the plunger assembly 30 therebetween, are compressed between the compressive faces 59 and 111 to a desired degree of partial precompression of the resiliently compressible members. This completes the assembly of the stress absorber 29. The assembled stress absorber 29 is then inserted in the sucker rod string by connecting the string adapter portion 49 of the plunger assembly 30 to the upper portion 25 of the sucker rod string and connecting the rod adapter portion 119 of the coupling 110 to the lower portion 27 of the sucker rod string.

It is presently anticipated that the resiliently compressible components of the stress absorber will be made of a resiliently compressible rubber-like material such as urethane and that all other components will normally be made of steel, though in some applications it might be desirable to use brass or some other suitable material.

In one embodiment now in use, the components are as follows:

| NO. | COMPONENT | MATERIAL | LENGTH | OUTER DIAMETER OD | INNER DIAMETER ID |
|---|---|---|---|---|---|
| 31 | SHAFT | Steel | 32½" | ¾" | |

-continued

| NO. | COMPONENT | MATERIAL | LENGTH | OUTER DIAMETER OD | INNER DIAMETER ID |
|---|---|---|---|---|---|
| 33 | HEAD | 41/40 Carbon Steel | 4" | 1½" | |
| 130 | HOUSING | 10/20 Carbon Steel | 24" | 1 11/16" | 1½" |
| 71 | CUSHION | Urethane | 5½" | 1½" | |
| 77 | DISK | 41/40 Carbon Steel | ½" | 1½" | |
| 91 | SLEEVE | Urethane | 10" | 1½" | ¾" |
| 110 | COUPLING | 41/40 Carbon Steel | 1⅞"* | 1½" | |
| 50 | GUIDE | 41/40 Carbon Steel | 1⅞"* | 1½" | ¾" |
| 37 | LOCK NUT | 41/40 Carbon Steel | ¾" | 1½" | ¾" |

*INSERTABLE LENGTH

The maximum precompression in this assembly is approximately one inch.

Thus, it is apparent that there has been provided, in accordance with the invention, a downhole stress absorber that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A downhole sucker rod string stress absorber comprising:

a plunger connected by a shaft to an upper portion of the sucker rod string;

a secondary stress absorber disposed between said plunger and a lower portion of the sucker rod string;

a primary stress absorber slidably mounted on said shaft above said plunger; and means rigidly fixed in relation to said lower portion of said string and slidably mounted on said rod for partially compressing said primary and secondary stress absorbers with said plunger therebetween.

2. A stress absorber according to claim 1, said secondary stress absorber comprising a resiliently compressible rod of circular cross-section.

3. A stress absorber according to claim 2, said secondary stress absorber further comprising a disk disposed between said compressible rod and said plunger.

4. A stress absorber according to claim 3, said compressible rod having a concentric bore in an upper end thereof and said disk having a concentric seating pin extending downwardly therefrom, said disk resting on said upper end of said compressible rod with said pin seated in said bore.

5. A stress absorber according to claim 4, said compressible rod being of rubberlike material and said disk being steel.

6. A stress absorber according to claim 1, said plunger comprising a comparatively inelastic rod of circular cross-section concentrically connected to a lower end of said shaft.

7. A stress absorber according to claim 6, said plunger being threadedly connected to said rod.

8. A stress absorber according to claim 7, .said plunger further comprising a locking means threaded on said shaft above said inelastic rod for securing said inelastic rod in position on said shaft.

9. A stress absorber according to claim 8 further comprising means for releasably securing said locking means against rotation about said shaft.

10. A stress absorber according to claim 9, said inelastic rod, said locking means and said shaft being steel.

11. A stress absorber according to claim 1, said primary stress absorber comprising a resiliently compressible cylindrical sleeve.

12. A stress absorber according to claim 11, said compressible cylindrical sleeve having a plurality of annular grooves spaced thereabout.

13. A stress absorber according to claim 12, said grooves being substantially equally spaced apart.

14. A stress absorber according to claim 11, said sleeve being of rubberlike material.

15. A stress absorber according to claim 1, said compressing means comprising:

a coupling adapted for connection to the lower portion of the sucker rod string and having a threaded end with a compressive face thereon abutting an end of said secondary stress absorber;

a guide slidably mounted on said shaft and having a threaded end with a compressive face thereon abutting an end of said primary stress absorber; and a cylindrical housing adapted at ends thereof to threadedly receive said coupling and said guide therein with said stress absorbers and said plunger therebetween, the length of said housing being such that said stress absorbers are increasingly partially compressed between said faces as said guide and/or said coupling are threaded further into said housing.

16. A stress absorber according to claim 15, said guide, said coupling and said housing being steel.

17. A downhole sucker rod string stress absorber comprising:

a relatively inelastic plunger of circular cross-section having a concentric shaft extending upwardly therefrom for connection to an upper portion of the sucker rod string;

a resiliently compressible rod of circular cross-section disposed below said plunger and above a lower portion of the sucker rod string;

a disk disposed between said compressible rod and said plunger;

a resiliently compressible cylindrical sleeve slidably mounted on said shaft above said plunger; and a coupling adapted for connection to the lower portion of the sucker rod string and having a threaded end with a compressive face thereon abutting an end of said compressible rod;

a guide slidably mounted on said shaft and having a threaded end with a compressive face thereon abutting an end of said compressible sleeve; and a cylindrical housing adapted at ends thereof to threadedly receive said coupling and said guide therein with said compressible rod, said compressible sleeve and said plunger therebetween, the length of said housing being such that said compressible rod and sleeve are increasingly partially compressed between said faces as said guide and/or said coupling are threaded further into said housing.

18. A stress absorber according to claim 17, said compressible rod having a concentric bore in an upper end thereof and said disk having a concentric seating pin extending downwardly therefrom, said disk resting on said upper end of said compressible rod with said pin seated in said bore.

19. A stress absorber according to claim 17, said plunger being threadedly connected to said rod and having a locking means threaded on said shaft above said plunger for securing said plunger in position on said shaft.

20. A stress absorber according to claim 19 further comprising means for releasably securing said locking means against rotation about said shaft.

21. A stress absorber according to claim .17, said compressible sleeve having a plurality of annular grooves spaced thereabout.

22. A downhole sucker rod string stress absorber comprising:

a relatively inelastic plunger of circular cross-section having a concentric shaft extending upwardly therefrom for connection to an upper portion of the sucker rod string;

a resiliently compressible rod of circular cross-section disposed below said plunger and above a lower portion of the sucker rod string and having a concentric bore in an upper end thereof;

a disk disposed between said compressible rod and said plunger and having a concentric seating pin extending downwardly into said bore;

a resiliently compressible cylindrical sleeve having a plurality of annular grooves spaced thereabout slidably mounted on said shaft above said plunger;

a coupling adapted for connection to the lower portion of the sucker rod string and having a threaded end with a compressive face thereon abutting an end of said compressible rod;

a guide slidably mounted on said shaft and having a threaded end with a compressive face thereon abutting an end of said compressible sleeve; and a cylindrical housing adapted at ends thereof to threadedly receive said coupling and said guide therein with said compressible rod, said compressible sleeve and said plunger therebetween, the length of said housing being such that said compressible rod and sleeve are increasingly partially compressed between said faces as said guide and/or said coupling are threaded further into said housing.

23. A stress absorber according to claim 22, said plunger being threadedly connected to said rod and having a locking means threaded on said shaft above said plunger for securing said plunger in position on said shaft.

* * * * *